US009578913B2

(12) United States Patent
McGoogan

(10) Patent No.: US 9,578,913 B2
(45) Date of Patent: Feb. 28, 2017

(54) TOBOGGAN STYLE HAT WITH REMOVABLE VISOR

(76) Inventor: John C. McGoogan, Atlanta, GA (US)

( * ) Notice: Subject to any disclaimer, the term of this patent is extended or adjusted under 35 U.S.C. 154(b) by 1276 days.

(21) Appl. No.: 13/045,012

(22) Filed: Mar. 10, 2011

(65) Prior Publication Data

US 2012/0227160 A1 Sep. 13, 2012

(51) Int. Cl.
*A42B 1/06* (2006.01)

(52) U.S. Cl.
CPC ..... *A42B 1/064* (2013.01); *A42B 1/062* (2013.01)

(58) Field of Classification Search
CPC ..... A42B 1/062; A42B 1/064
USPC ..... 2/195.1, 209.13, 10, 181, 181.2, 182.1, 2/422, 13, 209.7, 209.14, 175.1, 175.4, 2/195.2, 12, 207, DIG. 2, 181.4, 209.12, 2/209.11, 918
See application file for complete search history.

(56) References Cited

U.S. PATENT DOCUMENTS 5,367,713 A * 11/1994 McCallum ..... 2/209.12
5,437,062 A 8/1995 Douglas
5,613,246 A 3/1997 Alexander
5,715,534 A 2/1998 Mobley
5,862,523 A * 1/1999 Proctor ..... A42B 1/064 2/171
6,647,553 B2 * 11/2003 Hoyez ..... 2/209.12
6,804,831 B2 10/2004 Guerra
2001/0016958 A1 8/2001 Linday
2002/0000001 A1 1/2002 Hall McKenzie
2006/0005297 A1 1/2006 Blecha
2007/0017003 A1 1/2007 Harris et al.
2007/0061937 A1 3/2007 Curle
2007/0143906 A1 6/2007 Renteria
2008/0163405 A1 7/2008 Jacquart et al.

* cited by examiner

*Primary Examiner* — Khaled Annis
(74) *Attorney, Agent, or Firm* — Southeast IP Group, LLC.; Thomas L. Moses

(57) ABSTRACT

A toboggan style hat includes a removable visor, as well as novel means for removable attachment thereto. In a preferred embodiment, the visor member includes a pair of arms that extend rearwardly from the bill, and the hat includes a pair of holes on an underside thereof. Each hole serves as an opening for an inner sleeve, so that when a user wishes to attach the visor to the hat, the arms of the visor slide into the holes and along the inside of the sleeves in order to properly position the visor with respect to the hat and face. In one embodiment, a series of snaps are positioned on an outer portion of the visor, and correspond with a series of snaps that are positioned on an inner portion of the hat.

5 Claims, 4 Drawing Sheets

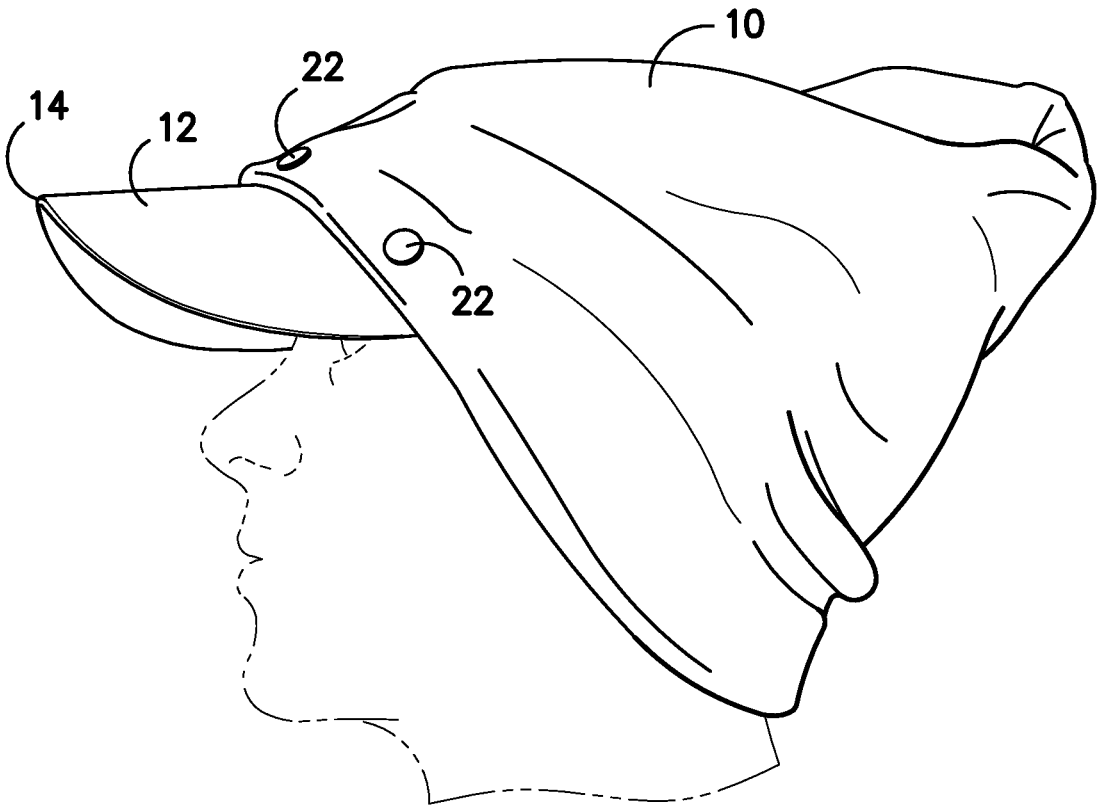
*FIG. –1A–*

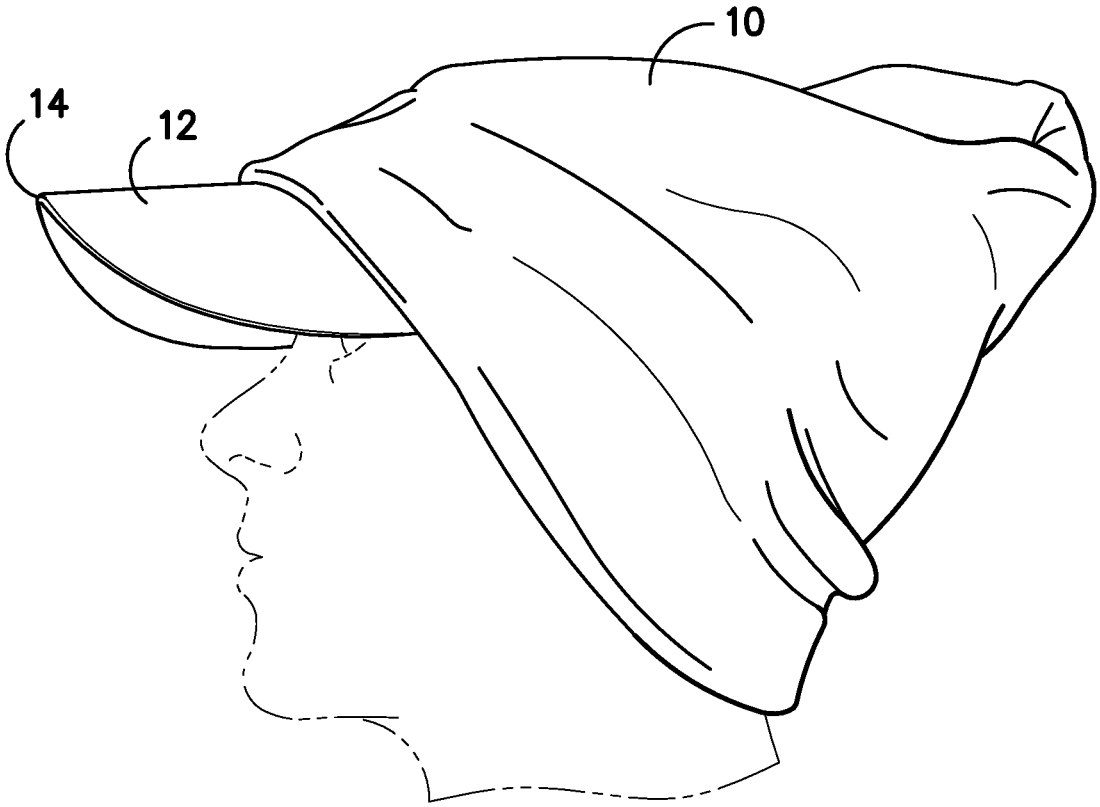
FIG. –1B–

TOBOGGAN STYLE HAT WITH REMOVABLE VISOR

BACKGROUND OF THE INVENTION

The present invention relates generally to cold weather hats and headwear. More specifically, the present invention includes a toboggan style hat with a removable baseball cap style visor.

There are currently many types of cold weather hats and headwear on the market. Toboggan style hats are traditionally made from thick material, such as a knit wool or fleece, and are manufactured to fit over the head and ears of a wearer. Other types of cold weather hats include military style hats with ear covers, bomber hats with ear flaps, and ski caps that cover the entire head and neck with an opening for a wearer's face or eyes. There are cold weather hats that include a bill or visor, but generally these visors do not extend far enough outwardly to effectively shade the sun or block the wind. Moreover, sometimes it is convenient and useful to have a visor on a cold weather style hat, and sometimes it is not. For example, on sunny days when wind is not a factor, having a visor on a cold weather hat to shade the wearer's eyes from the sun may be a beneficial feature. Correspondingly, when wind is a factor, a bill may be a beneficial feature to protect the eyes from the wind. Conversely, when the wearer is engaged in a high velocity sport such as snow skiing, snowboarding, boating, sledding, or riding a snowmobile, having a visor on the hat can be inconvenient and distracting. Under these conditions, it is not uncommon for the force of the wind to force the visor of the hat upwardly, so that the hat either blows off the wearer's head, or simply dislodges the hat from the preferred and comfortable position on the wearer's head. Additionally, on cloudy days, having a visor on the hat may be unnecessary, until rain, sleet or snow begins to fall, at which time the visor portion of the hat is most useful.

Therefore, it would be desirable to provide a cold weather hat, which could cover a user's head and ears, and which includes a removable visor that may be attached to the hat when desired, and removed when not needed. Further, it would be desirable to provide a means for removably attaching the visor to the hat so that the visor maintains a proper angle and position with respect to the hat and the wearer's face. Moreover, it would be desirable to provide a hat and removable visor assembly which is easy to operate, and in which several hats and several visors may be used interchangeably.

BRIEF SUMMARY OF THE INVENTION

In accordance with one aspect of the invention, a toboggan style hat includes a removable visor, as well as novel means for removable attachment thereto. In a preferred embodiment, the visor member includes a pair of arms that extend rearwardly from the bill, and the hat includes a pair of holes on an underside or inner portion thereof, each hole serving as an opening for an inner sleeve, so that when a user wishes to attach the visor to the hat, the arms of the visor slide into the holes and along the inside of the sleeves in order to properly position the visor with respect to the hat and face. In one embodiment, a series of snaps are positioned on an outer portion of the visor, and correspond with a series of snaps that are positioned on an inner portion of the hat. When the visor is not attached to the hat, the snaps on the interior of the hat may be covered by a flap of material affixed adjacent the snaps on the underside of the cap, to prevent the snaps from coming into direct contact with a wearer's head and causing discomfort. It is understood that other attachment means may be used to attach the front of the visor to the hat instead of snaps, including but not limited to hook and loop fasteners, zippers or other attachment means.

In one embodiment, when the visor is attached to the hat, the visor extends from an underside of the hat so that the front of the hat comes into contact with the top of the visor adjacent a wearer's forehead. Additionally, when the visor is not attached, the hat may be flipped around so that the attachment means (snaps, for instance) may be positioned adjacent the back of the wearer's head, rather than his or her forehead.

BRIEF DESCRIPTION OF THE DRAWINGS

These and other features, aspects, and advantages of the present invention will become better understood with regard to the following description, appended claims, and accompanying drawings where:

FIG. 1A is a perspective view of a toboggan style hat having a removable visor attached with snaps, in accordance with one aspect of the present invention;

FIG. 1B is a perspective view of a toboggan style hat having a removable visor attached, wherein the attachment means for attaching the hat and visor together are not visible when the hat and visor are positioned on a wearer's head;

DETAILED DESCRIPTION OF THE INVENTION

Figure 2:
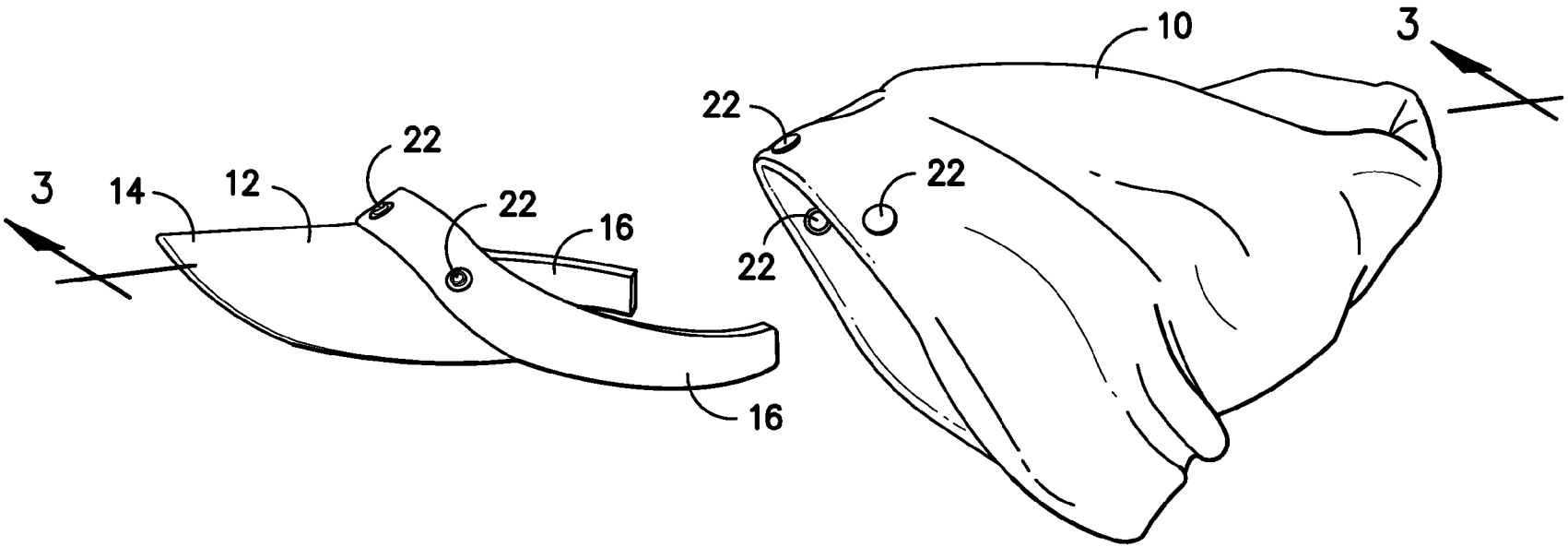
FIG. 2 is an exploded view of a toboggan style hat with a removable visor, in accordance with one aspect of the present invention.
Figure 3:
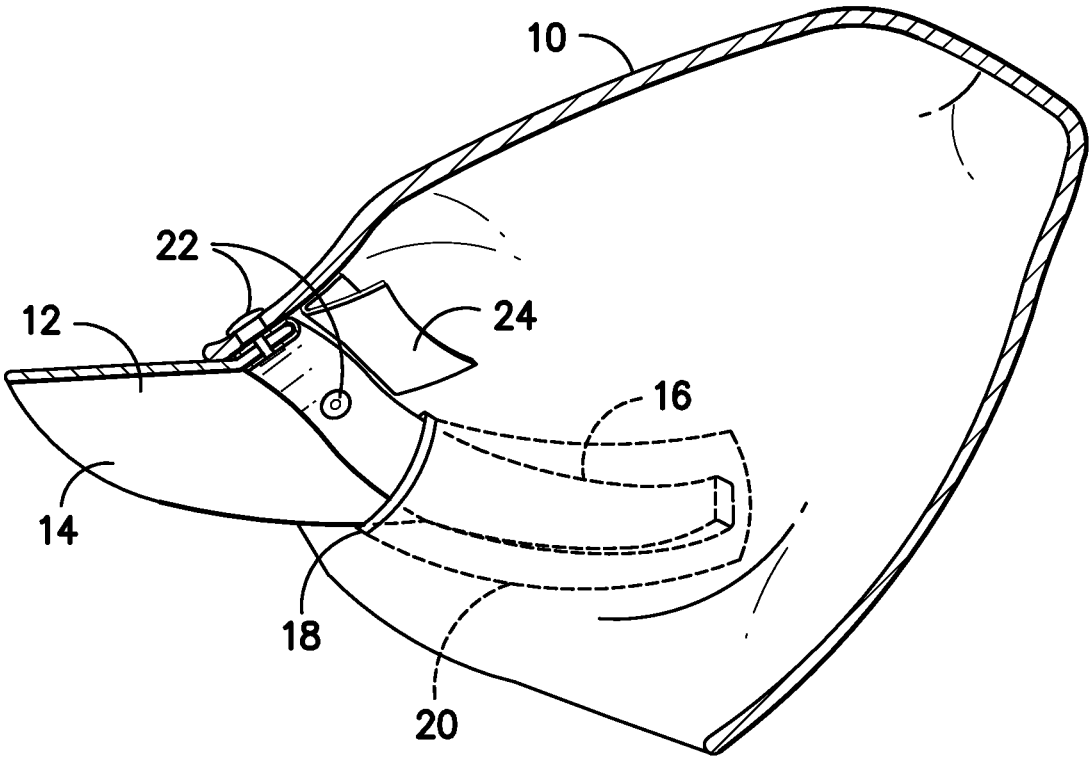
FIG. 3 is a side cut-away view along the lines 3-3 of a toboggan style hat having holes disposed on an underside thereof, and showing inner sleeves for receiving the arms of an attachable, removable visor.

A first embodiment of the toboggan style hat with a removable visor is shown in FIGS. 1-3. In a preferred embodiment, the hat 10 is made of a thick, warm material (such as wool, fleece, or other common cold-weather fabrics), and is shaped to fit over a user's head and ears. The removable visor 12 includes a bill member 14 with a pair of arms 16 extending rearwardly away from the bill member 14. The underside of the hat, in one embodiment, includes a pair of holes 18, wherein each hole serves as an opening for an inner sleeve 20 within the material of the hat 10. These sleeves 20 are used as guides, so that when a user wishes to attach the visor 12 to the hat 10, the arms 16 of the visor 12 are inserted into the holes 18, and are pushed back within the sleeves 20 on either side of the hat 10. When the visor 12 is in position with respect to the hat 10, and the arms 16 are properly inserted through the holes 18 and within the sleeves 20, the visor 12 may be secured to the hat using snaps 22, Velcro (mating hook and loop fastening material), zippers, or other attachment means.

In a preferred embodiment, the visor 12 includes a series of snaps 22 on an upper side thereof, and corresponding snaps 22 are positioned on an underside of the hat. One advantage of using snaps 22 over other types of attachment means is that the snaps 22 ensure that the visor 12 and hat 10 are properly positioned with respect to each other. It is contemplated that a flap of material 24 may be sewn onto the underside of the hat 10 adjacent the snaps 22, so that when the visor 12 is not in use with the hat 10, the flap 24 may be folded down over the snaps 22. In this way, the user may position the flap 24 between the snaps 22 and the user's head, as a type of cover or cushion. Additionally, when the visor 12 is not in position on the hat 10, the portion of the hat 10 with the snaps 22 may be turned around so that the snaps 22 are positioned adjacent the rear of the wearer's head. This arrangement allows a wearer to move the position of the snaps 22 away from his or her forehead, to alleviate any discomfort and prevent distraction caused by the snaps 22 rubbing against the user's forehead.

The arms 16 of the visor are preferably made from a pliable or semi-pliable material, and slide into the holes 18 and through the inner sleeves 20 within the interior of the hat material. These sleeves 20 are simply tubes, and may be made from any suitable material. For instance, the sleeves 20 may be made of fabric, plastic, or any other suitable material. The sleeves 20 should be fixed within the material of the hat 10, so that they do not freely slide around within the hat material. The sleeves 20 are angled in such a way that the visor 12 is fixed at a proper angle with respect to the hat 10 and face. The object is to prevent the visor 12 from being angled too far in an upward direction, which not only looks awkward, but also does not serve to keep the sun and/or wind out of a wearer's eyes, or too far in a lower direction, which also looks awkward and interferes with the upper field of a user's vision. The sleeves 20 are angled so that when the visor 12 is positioned on the hat 10 with the visor arms 16 fully extended within the sleeves 20, the visor 12 is properly situated with respect to the hat 10 and the wearer's face.

In one embodiment, the hat 10 may comprise an outer layer of fabric or material, and an inner layer of material. In this case, the sleeves 20 for receiving the arms 16 of the visor 12 may be positioned between the outer and inner layers of material, oriented at a proper angle, and preferably fixed in place between the layers, either by being sewn or glued in place (although any suitable method for fixing the sleeves in place within the hat material may be used). The holes or openings 18 are an open first end of the sleeves 20 positioned on the inner layer of material and having a second closed end as shown in FIG. 3, so that the holes 18 are not visible when the hat 10 is in place on a wearer's head. In another embodiment, the hat may comprise a single layer of material, and the sleeves may be attached to an underside of the single layer in any suitable manner.

One advantage of this arrangement is that a series of visors 12 and hats 10 may be used interchangeably, so that a wearer may select any of a number of hats 10 (each of a different color, for instance), as well as any of a number of visors 12, in any desired combination. In this way, a user may mix and match colors, patterns, and designs in any desired manner. It is also contemplated that the visor 12 may be worn separately without the hat 10, and the hat 10 may be worn without the visor 12.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What I claim is:

1. A cold weather hat with a removable visor comprising:

a hat member that fits snugly over a wearer's head and ears, wherein said hat member includes an outer side and an inner side;

said inner side of said hat member defining a pair of holes;

wherein each said hole is an open first end of an inner tube positioned adjacent said inner side of said hat member wherein said inner tube has a second closed end, and wherein each said inner tube is oriented at an upward angle toward a top of said hat member;

a first removable visor member comprising a bill member and a pair of arms extending rearwardly away from said bill member; and wherein said arms of said first removable visor member are adapted to be received within said holes and positioned within each said inner tube when said visor member is removably attached to said hat member.

2. The cold weather hat with a removable visor set forth in claim 1, further comprising attachment means for attaching said hat member to said bill member.

3. The cold weather hat with a removable visor set forth in claim 2, wherein said attachment means includes at least one snap member attached to said inner side of said hat member that corresponds with at least one snap member attached to an outer portion of said bill member.

4. The cold weather hat with a removable visor set forth in claim 3, wherein said attachment means includes a plurality of snap members attached to said hat member, and a corresponding number of snap members attached to said bill member.

5. The cold weather hat with a removable visor set forth in claim 1, further including a second removable visor member that may be attached to said hat member and used interchangeably with said first removable visor member.

* * * * *